US009083099B2

(12) United States Patent
Yi

(10) Patent No.: US 9,083,099 B2
(45) Date of Patent: Jul. 14, 2015

(54) MAGNETIC ALLIGATOR CLIP

(71) Applicant: Steve Yi, Walnut, CA (US)

(72) Inventor: Steve Yi, Walnut, CA (US)

(73) Assignee: Young Chang T.I.W. Co., Ltd., Seoul (KR)

( * ) Notice: Subject to any disclaimer, the term of this patent is extended or adjusted under 35 U.S.C. 154(b) by 14 days.

(21) Appl. No.: 14/099,814

(22) Filed: Dec. 6, 2013

(65) Prior Publication Data

US 2015/0079811 A1 Mar. 19, 2015

Related U.S. Application Data

(60) Provisional application No. 61/877,389, filed on Sep. 13, 2013.

(51) Int. Cl.
*H01R 11/30* (2006.01)

(52) U.S. Cl.
CPC ..... *H01R 11/30* (2013.01)

(58) Field of Classification Search
CPC ..... H01R 11/282; H01R 11/22; H01R 11/24; H01R 13/6205; H01R 11/30
USPC ..... 439/829, 729, 504, 38, 40
See application file for complete search history.

(56) References Cited

U.S. PATENT DOCUMENTS

| | | | | |
|---|---|---|---|---|
| 3,963,857 | A | 6/1976 | Reynolds | |
| 4,112,941 | A | 9/1978 | Larimore | |
| 4,211,456 | A | 7/1980 | Sears | |
| 4,384,752 | A | 5/1983 | Gabriel | |
| 4,719,549 | A | 1/1988 | Apel | |
| 4,815,991 | A | 3/1989 | Bakke | |
| 5,053,595 | A | 10/1991 | Derbyshire | |
| 5,658,163 | A | 8/1997 | DeRoss | |
| 5,881,488 | A * | 3/1999 | Canepa | 43/4.5 |
| 6,565,363 | B2 | 5/2003 | Downing | |
| 6,871,387 | B2 * | 3/2005 | Cheng et al. | 24/499 |
| 7,264,479 | B1 | 9/2007 | Lee | |
| 7,298,136 | B1 | 11/2007 | Curtis | |
| 7,311,526 | B2 | 12/2007 | Rohrbach | |
| 7,467,948 | B2 | 12/2008 | Lindberg | |
| 7,637,746 | B2 | 12/2009 | Lindberg | |
| 7,762,817 | B2 | 7/2010 | Ligtenberg | |
| 7,963,773 | B2 | 6/2011 | Palli | |
| 8,016,599 | B1 | 9/2011 | Melby | |
| 2004/0175991 | A1 * | 9/2004 | Cheng et al. | 439/621 |
| 2007/0287326 | A1 * | 12/2007 | Grippe | 439/504 |
| 2008/0067044 | A1 | 3/2008 | Schwartzbart | |
| 2010/0325842 | A1 * | 12/2010 | Rivera | 24/3.4 |
| 2012/0169076 | A1 * | 7/2012 | Brake et al. | 294/3.6 |
| 2012/0329293 | A1 * | 12/2012 | Wang | 439/40 |

OTHER PUBLICATIONS

Patch Cords and Test Leads, *EDGE*, Catalog [online], Oct. 15, 2006; http://sheildselectronics.com/ecats/testcat/patch.pdf, (Oct. 15, 2006).

* cited by examiner

*Primary Examiner* — Gary Paumen
(74) *Attorney, Agent, or Firm* — Blakely Sokoloff Taylor & Zafman LLP

(57) ABSTRACT

A magnetic alligator clip is described. The alligator clip comprising, a pair of conductive gripping jaws attached to each other, biasing means for biasing a first end of the conductive gripping jaws towards each other, and a magnet disposed at the first end of one of the conductive gripping jaws. Also described is an electrical lead having at least one wire, each of the wires having a magnetic alligator clip electrically connected at each end. An extension for the magnetic alligator clip is also described.

17 Claims, 14 Drawing Sheets

MAGNETIC ALLIGATOR CLIP

FIELD OF THE INVENTION

The present invention relates generally to alligator clips, and to alligator clips used for electrical leads, in particular the present invention relates to alligator clips that can be clipped or magnetically connected to a terminal and the use of such clips with an electrical lead and/or electrical test leads, an extension for the magnetic alligator clip is also described.

BACKGROUND

Electrical jumper or test leads are used to connect to terminals. They may be used in order to form electrical connections, bypass electrical circuits for testing and for other troubleshooting purposes. Jumper leads using alligator clips can be clipped onto terminals formed of any material. Also known are test leads having magnetic ends that can be magnetically attached to ferromagnetic materials, some allowing connection to recessed ferromagnetic screws. No leads facilitating mechanical and magnetic connection are known to exist in the prior art.

Thus there is a need for an electrical connector that allows a user to clip onto a terminal, magnetically connect to a terminal or both clip and magnetically connect to a terminal or to at least provide the public or industry with a useful choice.

SUMMARY OF THE INVENTION

It is acknowledged that the terms "comprise", "comprises" and "comprising" may, under varying jurisdictions, be attributed with either an exclusive or an inclusive meaning. For the purpose of this specification, and unless otherwise noted, these terms are intended to have an inclusive meaning—i.e. they will be taken to mean an inclusion of the listed components that the use directly references, but optionally also the inclusion of other non-specified components or elements.

In one embodiment the invention consists in an alligator clip comprising a pair of conductive gripping jaws attached to each other, biasing means for biasing a first end of the conductive gripping jaws towards each other, and a magnet disposed at the first end of one of the conductive gripping jaws.

The magnet is preferably in electrical connectivity with the conductive gripping jaw and preferably secured at the first end of one of the conductive gripping jaws.

In one embodiment the magnet is preferably secured using adhesive including an epoxy adhesive.

In an alternative embodiment each of the conductive gripping jaws is substantially 'U' shaped, having first and second opposite side walls and a bottom wall and the magnet is an interference fit between the first and second side walls.

In a further embodiment each of the conductive gripping jaws is substantially 'U' shaped, having first and second opposite side walls and a bottom wall and wherein at least one sidewall has at least one protrusion that assists in securing the magnet between the first and second opposite side walls.

Preferably the at least one protrusion protrudes into an indent in the magnet.

In a further embodiment each of the conductive gripping jaws is substantially 'U' shaped, having first and second opposite side walls and a bottom wall and wherein the magnet is staked to the conductive gripping jaw.

In a further embodiment the alligator clip has an extension, the extension being attached at a first end of the extension to the first end of the alligator clip and wherein the second opposite end of the extension extends beyond the first end of the clip, the extension being electrically connected to the conductive gripping jaws.

Preferably the extension is in the form of a rod.

Preferably the extension is secured to the alligator clip by the magnetic force of the magnet.

Alternatively the extension is held between the conductive gripping jaws thereby being secured to the alligator clip.

Alternatively the extension is threaded at a first end and at least a part of the thread is screwed into a threaded socket in the magnet thereby being secured to the alligator clip.

Preferably the magnetic force of the magnet passes through the extension thereby creating a magnetic attraction at the second end of the extension.

In further embodiment the invention consists in an electrical lead having at least one wire, each of the wires having an alligator clip electrically connected at each end. The alligator clip comprising a pair of conductive gripping jaws attached to each other, biasing means for biasing a first end of the conductive gripping jaws towards each other, and a magnet disposed at the first end of one of the conductive gripping jaws.

In a yet further aspect there is provided an electrical connector comprising:

a. a mechanical attachment mechanism for mechanically gripping a terminal; and b. a magnet for facilitating attachment of the connector to a ferromagnetic terminal.

BRIEF DESCRIPTION OF THE DRAWINGS

Embodiments of the present invention will now be described, by way of example only, with reference to the accompanying drawings, in which.

DETAILED DESCRIPTION OF THE INVENTION

Figure 1:
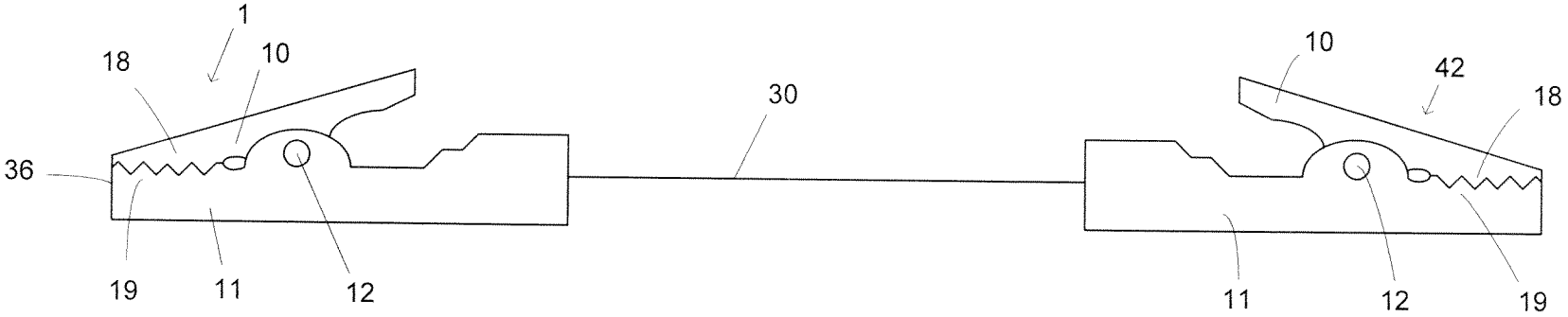
FIG. 1 is a side view of the electrical lead in one embodiment of the present invention.

As shown in FIG. 1 the present invention provides an improved alligator clip 1.

Referring to FIG. 1 a first member 10 and a second member 11 are pivotally connected to each other. In one embodiment the first member 10 and the second member 11 are pivotally connected using a pin 12. The clip members or gripping jaws 10, 11 are made of an electrically conductive material such as steel.

Figure 2:
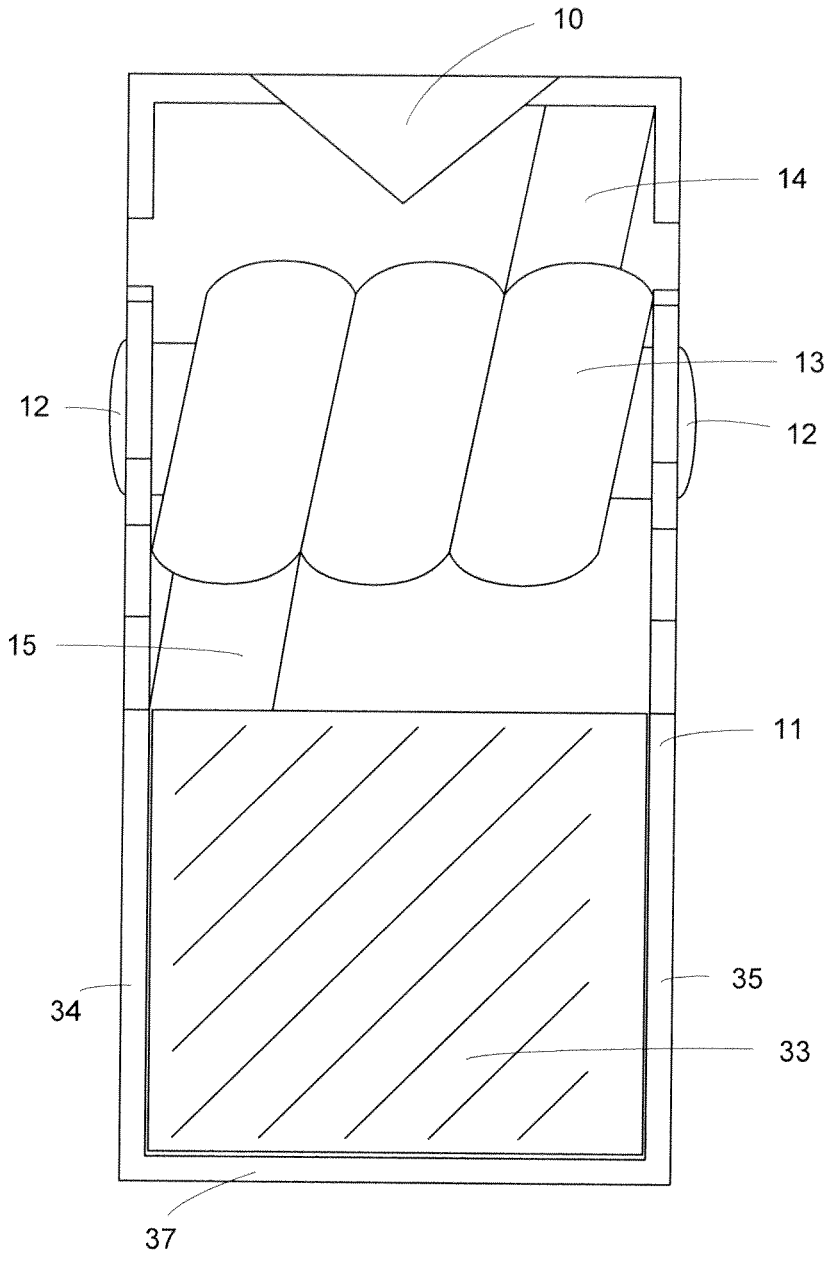
FIG. 2 shows a front view of an alligator clip with the jaws shown open.

Referring to FIG. 2 the alligator clip 1 further comprises a biasing member 13 to bias the first 10 and second 11 members towards each other at one end 36 of the alligator clip 1 to provide the clipping function of the allocator clip 1.

In one embodiment the biasing member 13 is a resilient member furnished on the pin 12. The resilient member 13 would typically be a spring but any other suitable device could be used. The resilient member 13 has two opposite ends 14 and 15 in contact with the interior surfaces of the first 10 and second 11 clip members.

Referring to the Figures the first 10 and second 11 members each have two parallel rows of teeth or serrations 18, 19. When the first 10 and second 11 members are biased towards each other at the end 36 the teeth 18, 19 mate in an interlocking fashion.

Figure 3A:
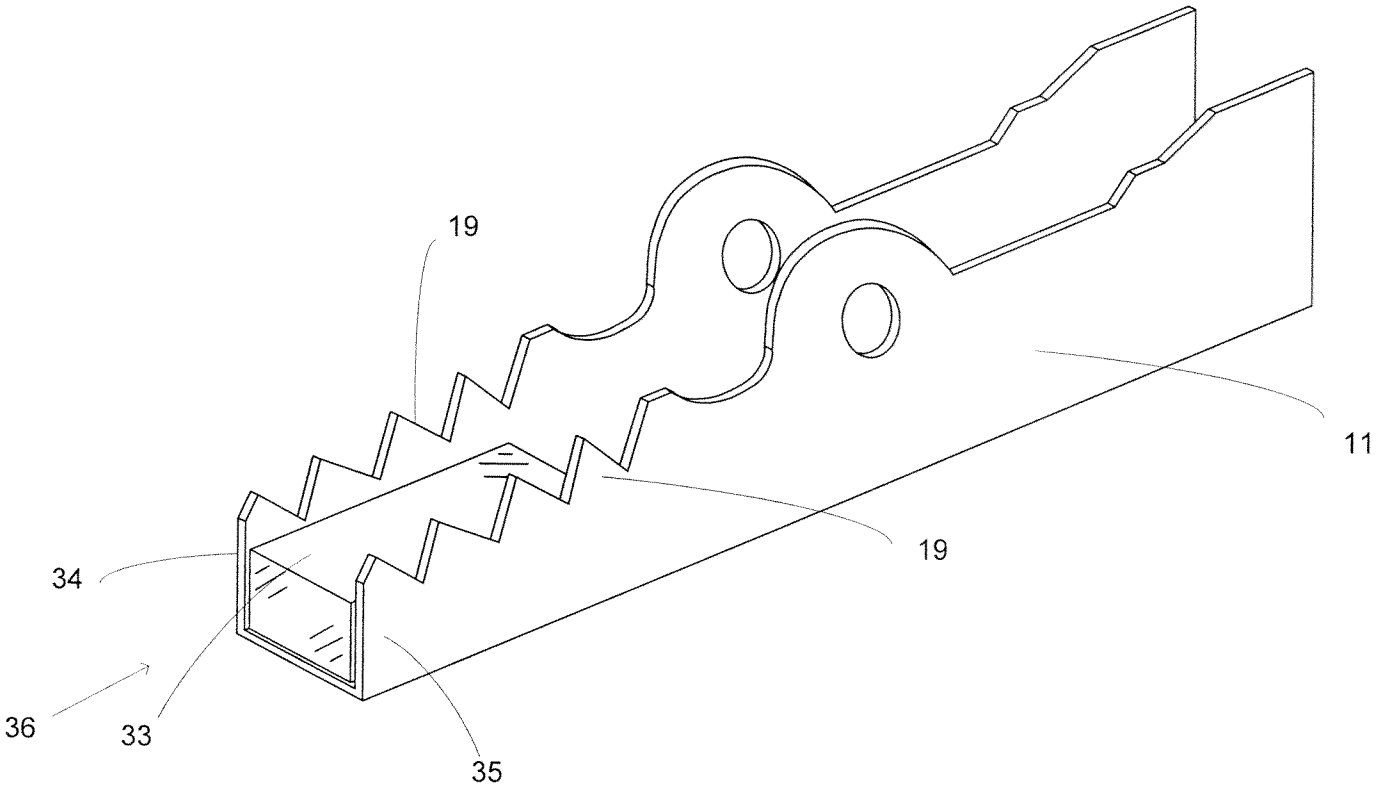
FIG. 3A shows a perspective view of the bottom jaw of the alligator clip in one embodiment of the invention.
Figure 3B:
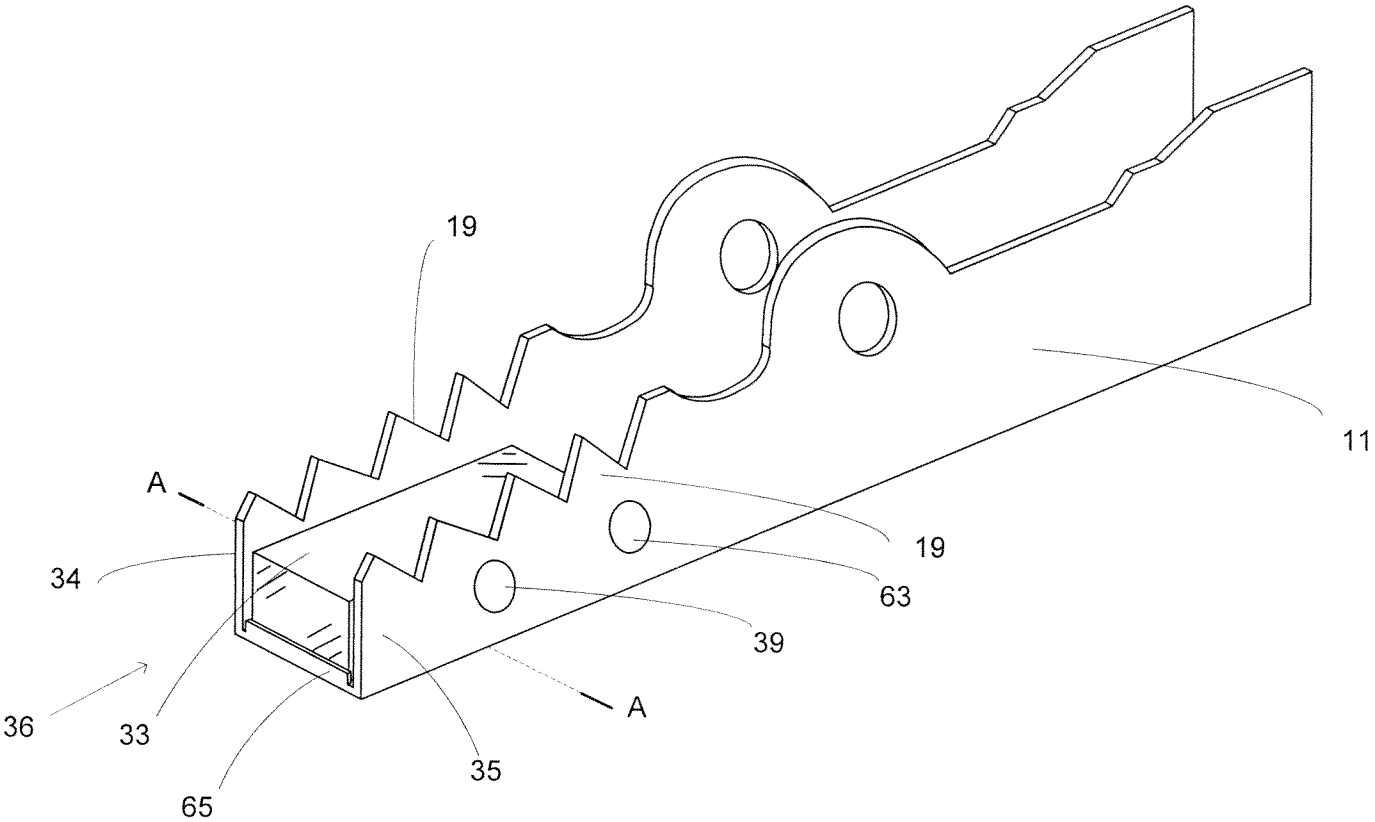
FIG. 3B shows a perspective view of the bottom jaw of the alligator clip of another embodiment of the invention.
Figure 3C:
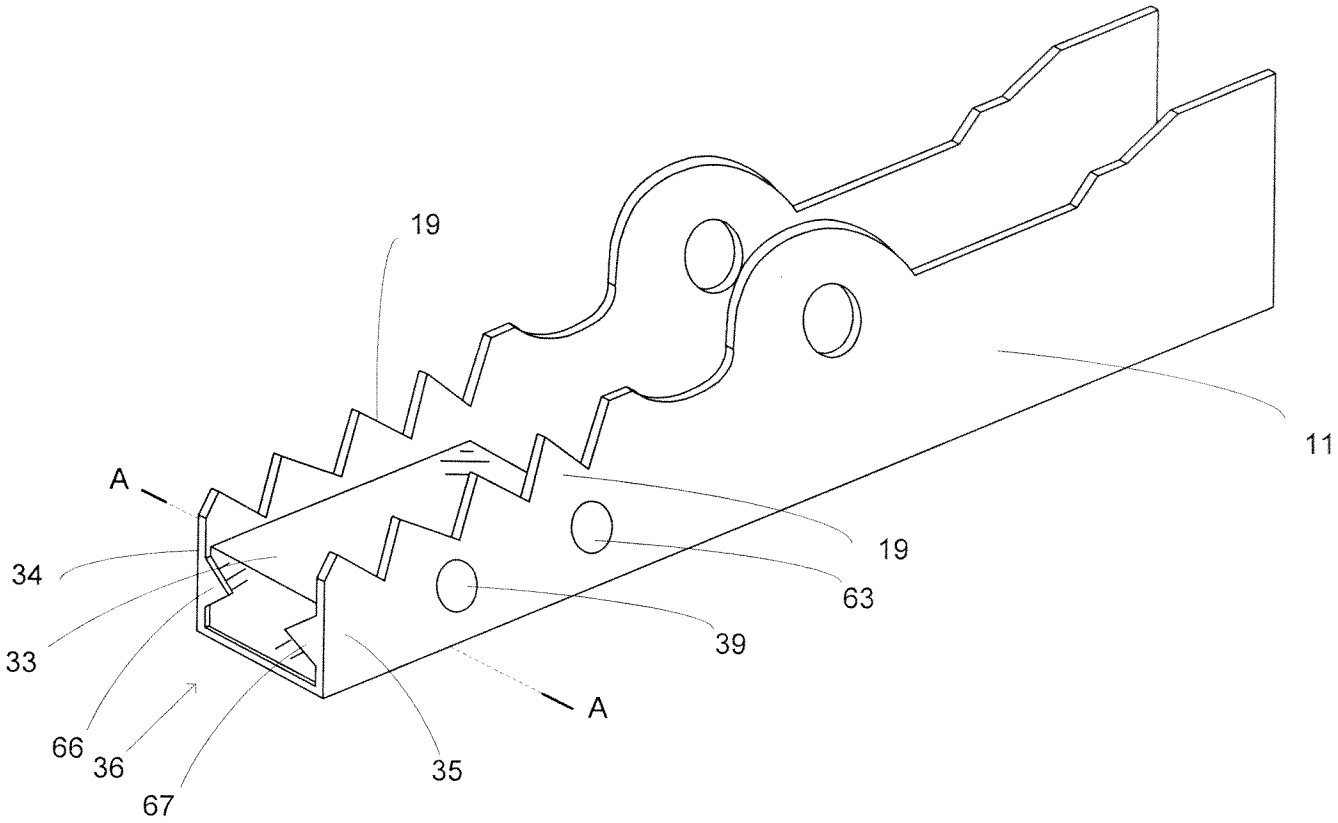
FIG. 3C shows a perspective view of the bottom jaw of the alligator clip of another embodiment of the invention.

Referring to FIGS. 3A, 3B and 3C a magnet 33 is attached at the end 36 of the alligator clip 1 that provides the clipping function. The magnet 33 may be in electrical connectivity with the clip member 11 to which the magnet 33 is attached.

The magnet 33 may be attached or secured to the clip member using an adhesive or glue. An epoxy adhesive may for example be used but any suitable adhesive may be used.

Figure 4:
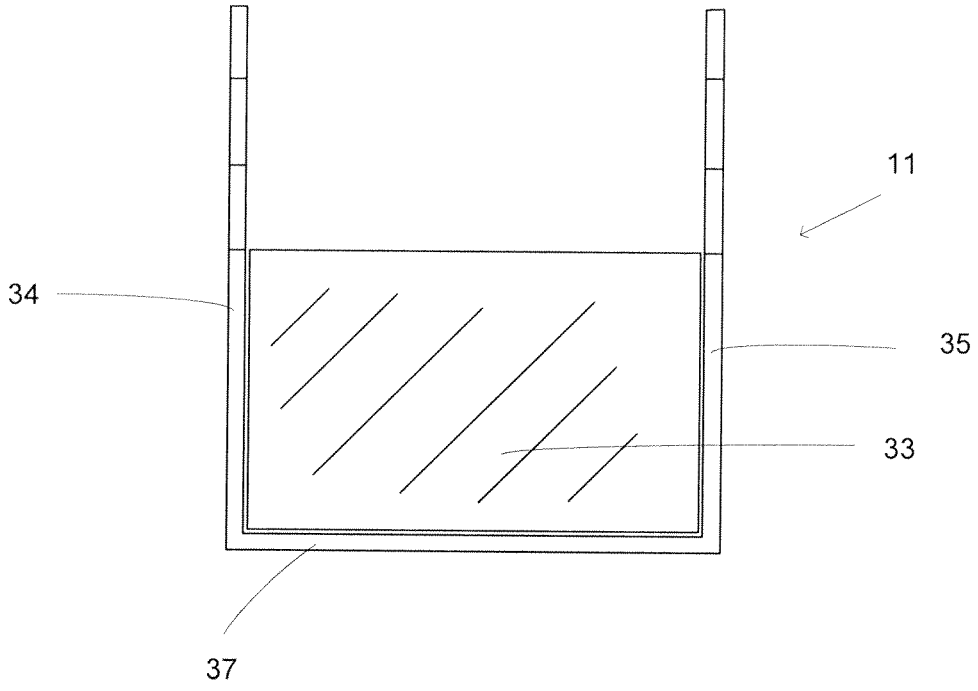
FIG. 4 shows a front view of the bottom jaw of the alligator clip.

Referring to FIG. 4 in an alternative embodiment the magnet 33 may be an interference fit in the clip member 11 to which the magnet is placed or secured. The clip member when viewed from the end 36 is typically 'U' shaped, having two substantially parallel sides 34, 35 and a bottom 37. The magnet 33 is sized such that it is a tight or interference fit between the sides 34, 35, so that in use the magnet 33 is held securely in place.

In another further embodiment the magnet 33 may be an interference fit between the sides 33, 34 and additionally be attached to the clip member 11 using an adhesive.

Figure 5A:
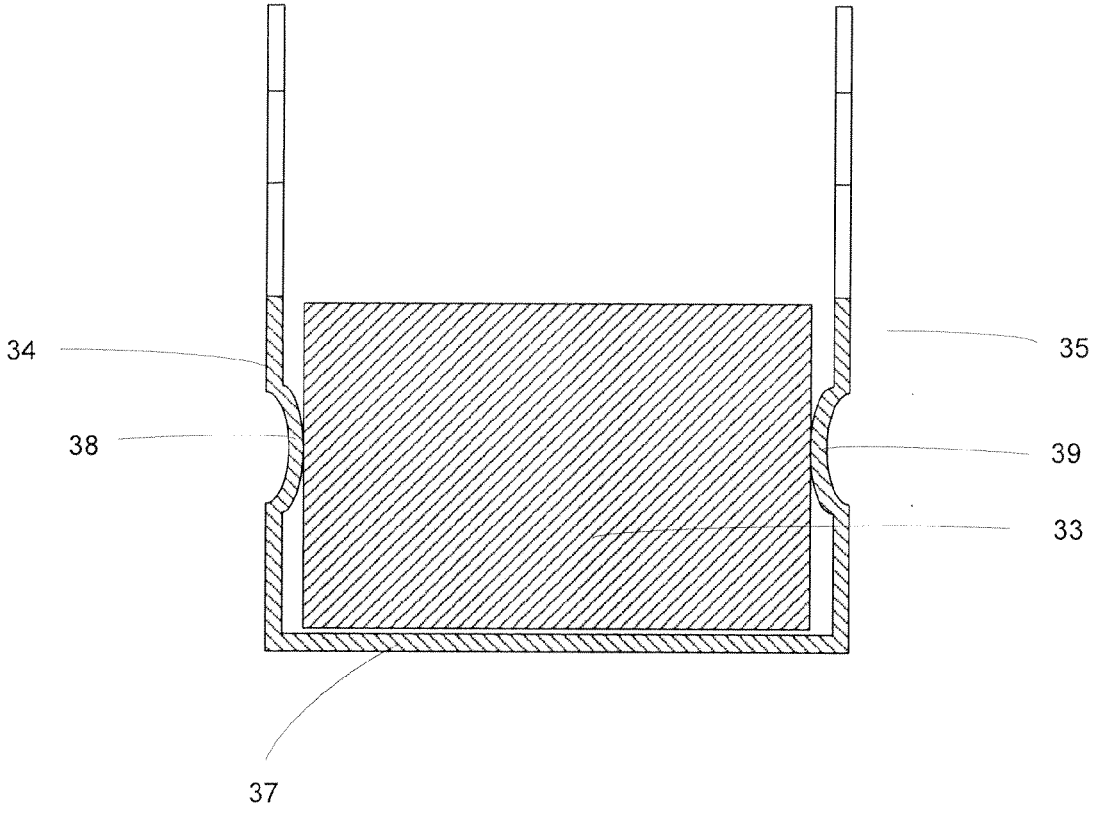
FIG. 5A shows a cross section of the bottom jaw of the alligator clip of one embodiment of the invention along the line A-A of FIG. 3B.

Referring specifically to FIG. 5A in a further alternative embodiment the magnet 33 may be held in place by protrusions 38, 39 in the side walls 34, 35 of the clip member 11 and optionally additional protrusions 63 and 64.

Figure 5B:
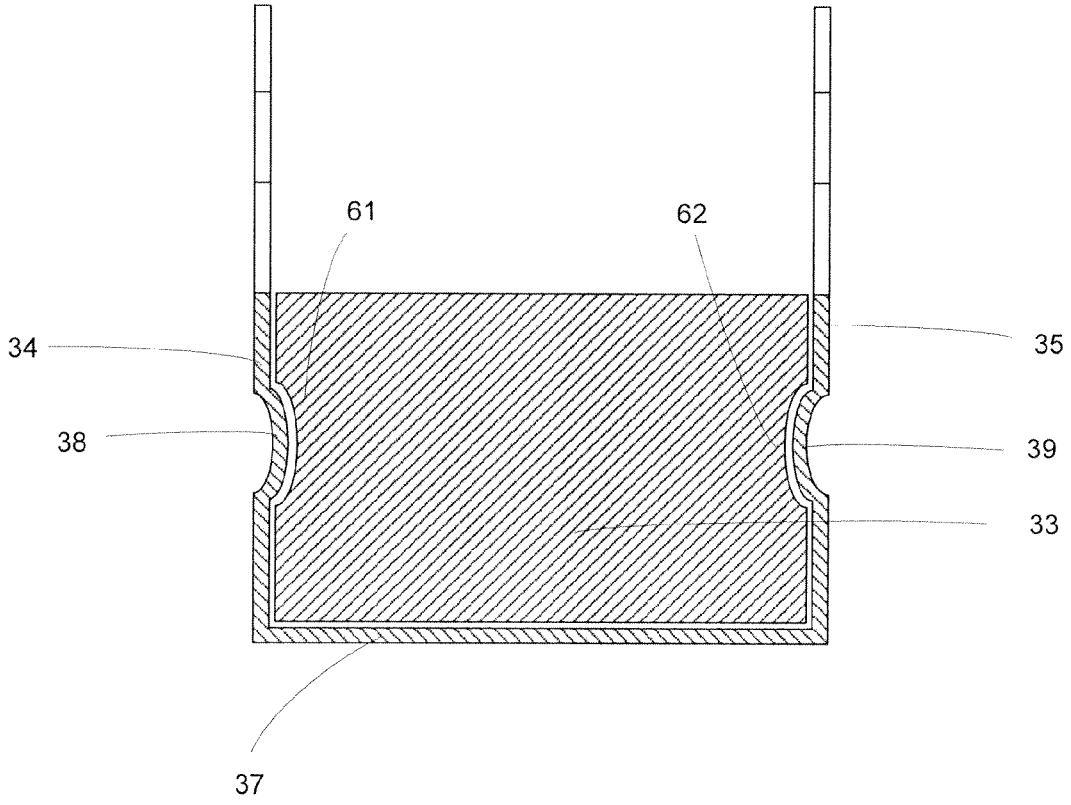
FIG. 5B shows a cross section of the bottom jaw of the alligator clip of an alternative embodiment of the invention along the line A-A of FIG. 3C.

In yet a further embodiment seen in FIG. 5B the protrusions 38, 39 would protrude into an indent or hole 61, 62 in the magnet 33 so as to hold and secure the magnet 33 in place. The insertion or squeezing of a protrusion 38, 39 formed in one part inside a hole 61, 62 in the second part is generally known in engineering as fastening one part to another by staking. Optionally additional protrusions 63 and 64 may be provided.

Figure 6:
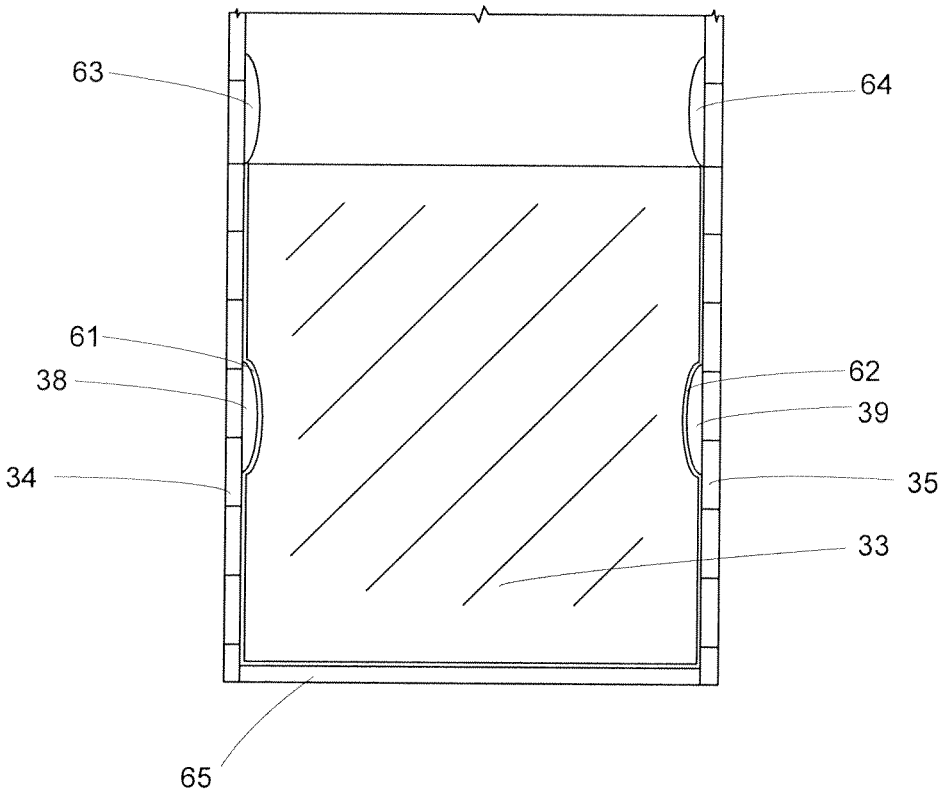
FIG. 6 shows a top view of part of the bottom jaw of the alligator clip of an embodiment of the invention.

In a further embodiment seen in FIG. 6 the magnet 33 has slots 61 and 62 on either side of the magnet 33. There are protrusions 38, 39 in the side walls 34 and 35 respectively of clip member 11 and optionally additional protrusions 63 and 64. The magnet is inserted into the clip member 11 so that the protrusions 38, 39 are within the slots 61, 62 of the magnet 33 to secure the magnet within the clip member. The additional protrusions 63, 64 provide additional support in securing the magnet.

Optionally and in a further embodiment seen in FIGS. 3B and 3C the magnet 33 may additionally be secured within the clip member 11 at end 36. In one embodiment seen in FIG. 3C the magnet 33 could be secured by tabs 66 and 67 that fold from the sides 10, 11. In another embodiment seen in FIG. 3B an elongated tab 65 substantially extending the width of the bottom 37 assists in securing the magnet 33.

Having a magnet 33 at the end of the jaws/clip member means that the alligator clip 1 of the present invention can be connected to a terminal by being clipped onto the terminal or by being magnetically attached to the terminal. In some cases the alligator clip 1 of the present invention could be both clipped and magnetically attached a terminal.

Having the ability to either clip on, magnetically attach or clip and magnetically attach has advantages. In some case the terminals will not be suitable for the clip to magnetically attach as the terminal may not have sufficient or any magnetic attraction, in those cases the alligator clip 1 can be clipped on. This is advantageous in that the same lead can be used whether or not the lead needs to be clipped on or magnetically attached.

The alligator clip 1 of the present invention can be made in different sizes for different applications and a magnet of the appropriate size and magnetic strength would be used depending on the size of the alligator clip and the use the clip is to be put too. In one embodiment a neodymium magnet such as an NdFeB magnet with a material property of 50 MGOe (N50 magnet) would be used.

The magnetic alligator clip 1 of the present invention would typically be used for electrical leads, typically these would be test or jumper leads that are used to connect to terminals in order to bypass electrical circuits for testing and other troubleshooting purposes.

Referring to FIGS. 9 to 14 the magnetic alligator clip 1 of the present invention may further include an extension 50 in the form of a cylindrical rod. The extension 50 is electrically attached to the alligator clip 1. In addition it is physically attached to the alligator clip 1, the attachment could be magnetic, or the extension may include a tab 51 or 52 as particularly seen in FIGS. 10 and 11. In use the jaws 10, 11 of the clip 1 would clamp on the tab 51 or 52 of the extension to hold and electrically connect the extension to the alligator clip 1.

In a further embodiment the extension 50 has a threaded part 53 that screws into the end of the clip 1. Such an extension is useful for countersunk terminals such as countersunk screws.

The extension 50 may be magnetic or may allow the magnetic force of the magnet 33 to pass through.

Figure 14:
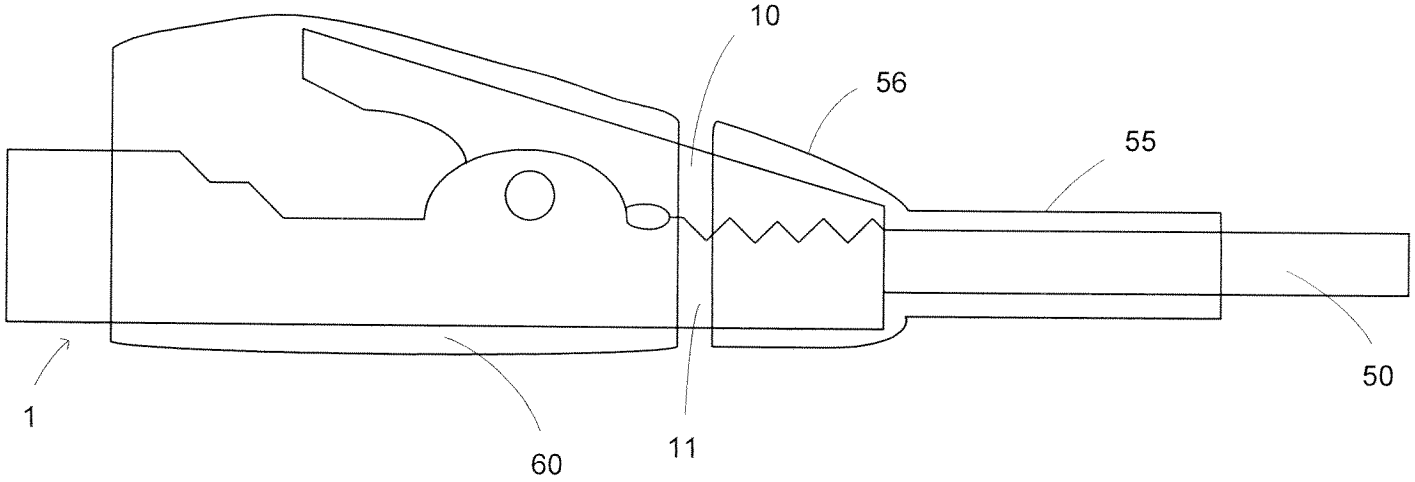
FIG. 14 is a partial side view of clip of the present invention with the extension installed showing the clip and clip extension insulators.

The extension 50 may be insulated and as seen in FIG. 14 the insulation 55 may assist in securing the extension 50 to the clip 1 as the insulation may include a cup 56 that extends over the jaws 10, 11.

The length of the extension 50 would vary depending on the application the extension is to be used for but in one embodiment the extension would extend 1 cm from the end 36 of the clip 1

Figure 7:
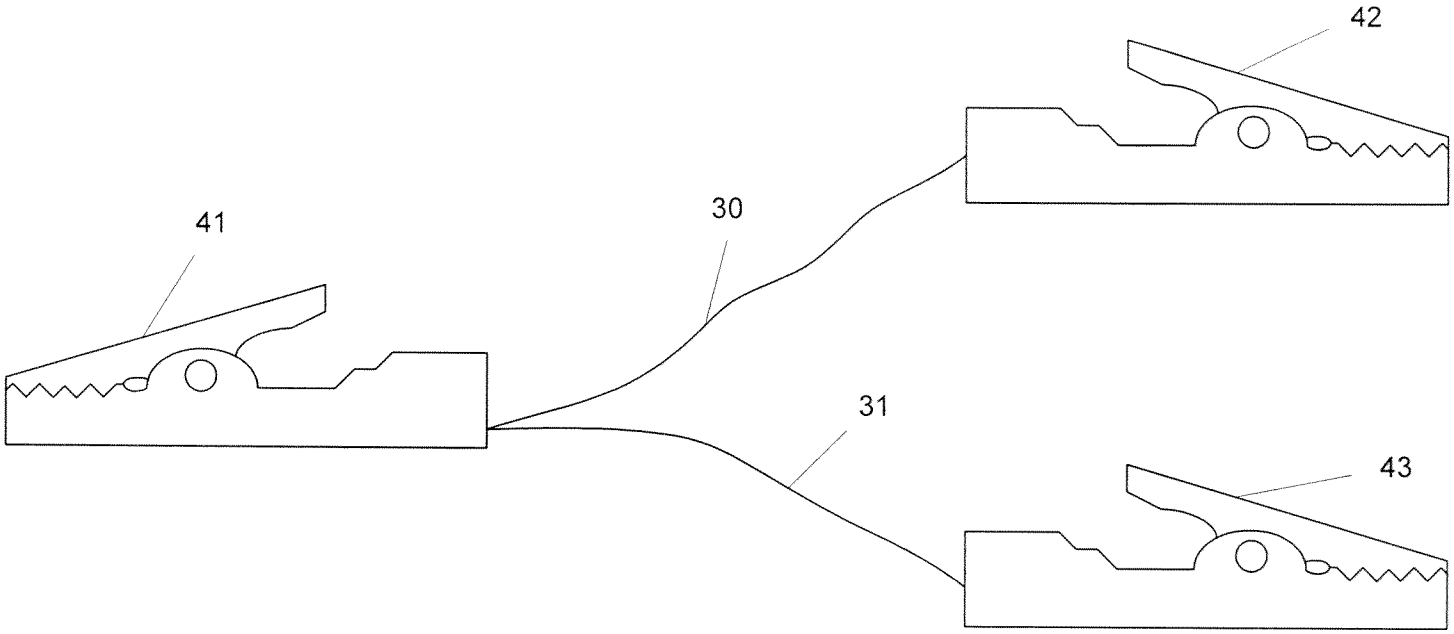
FIG. 7 is a side view of an electrical 'Y' lead in a further embodiment of the present invention.
Figure 8:
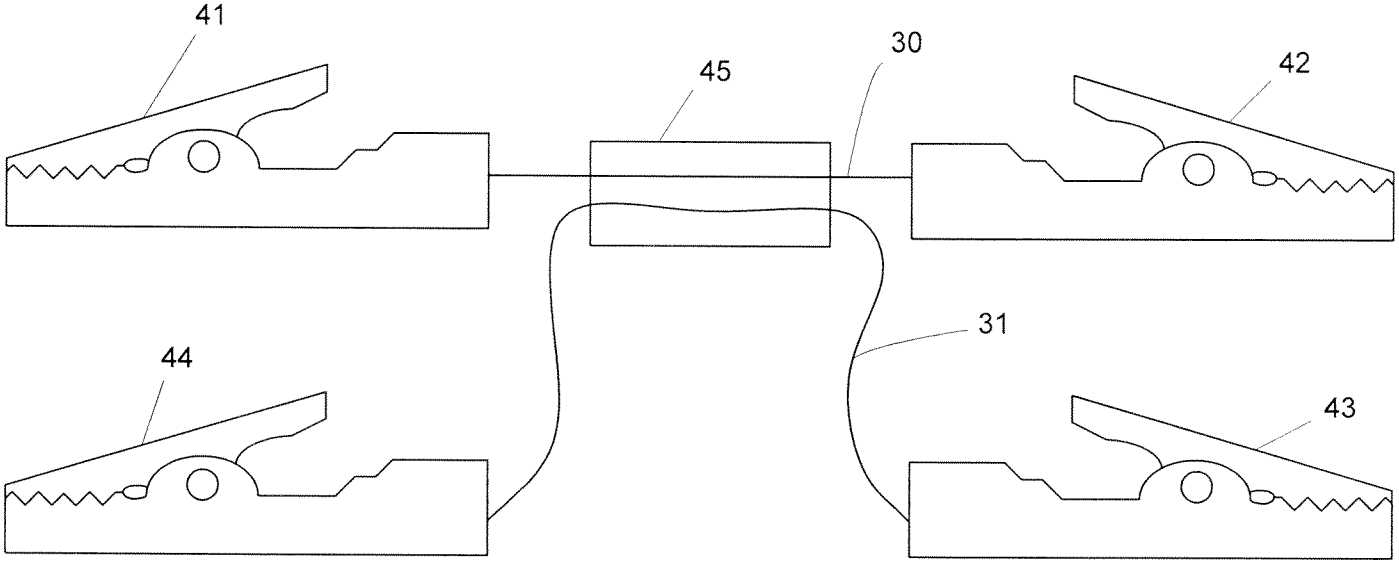
FIG. 8 is a side view of an electrical lead set in a further embodiment of the present invention.
Figure 9:
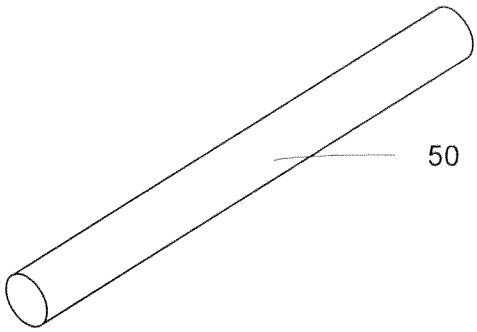
FIG. 9 is a perspective view of a clip extension.
Figure 10:
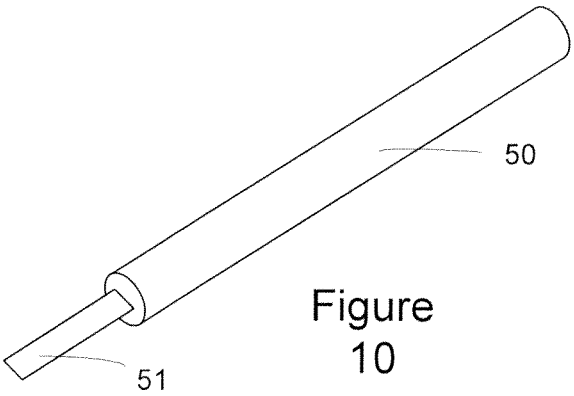
FIG. 10 is a perspective view of an alternative clip extension.
Figure 11:
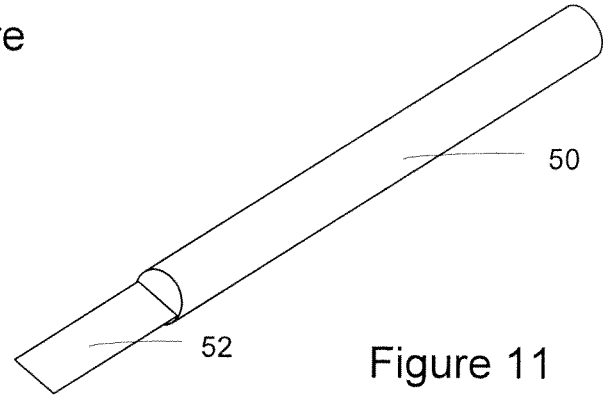
FIG. 11 is a perspective view of further alternative clip extension.
Figure 12:
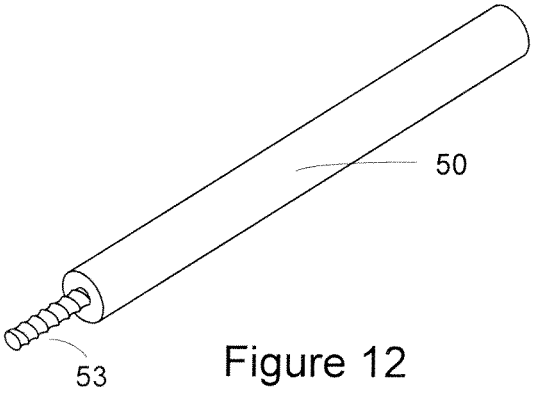
FIG. 12 is a perspective view of further alternative clip extension.
Figure 13:
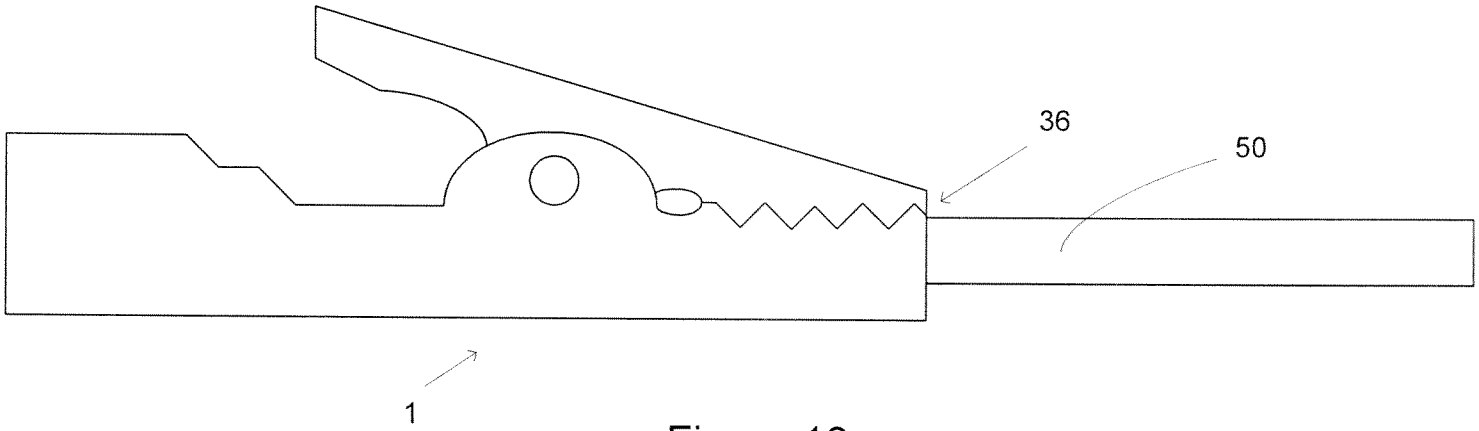
FIG. 13 is a side view of clip of the present invention with the extension installed.

Referring to FIGS. 1, 7 and 8 the magnetic alligator clip 1 of the present invention may be used in pairs electrically connected together via a lead or cable 30. The clip members or gripping jaws II, 12 at one end of the lead/cable are electrically connected to like clip members with gripping jaws II, 12 at the other end of the lead or cable 30.

The lead or cable 30 would typically be an insulated lead/cable and in one embodiment of the present invention the alligator clip 1 would be partially insulated so that a user could connect the alligator clip 1 to a terminal (not shown) insulated from the electrical current. Referring to FIG. 14 the insulation could be a sheath 60 that covers a substantial part of the clip 1. The sheath 60 could be made of rubber or plastic or any other suitable electrically insulating material.

In an alternative embodiment seen in FIG. 7 one magnetic alligator clip 41 would be connected via two separate cables 30, 31 to two separate alligator clips 42, 43. Such a 'Y' shaped cable would be used for connecting a single terminal to two other terminals.

While not illustrated it is understood the cable could be made in any form, for example having a third or fourth cable/lead connected to a single connector at one end for connecting a single terminal and at the other end having a clip on each lead for connection to multiple terminals.

In another embodiment seen in FIG. 8 multiple magnetic alligator clips leads could be run in parallel and the multiple cables 30, 31 of the multiple leads could be contained within an outer sheath 45 so that there are multiple test leads in one sheath. Each lead 30, 31 connects to independent terminals at one end 41, 44 and to the same number of independent terminals at the other end 42, 43.

In another embodiment the leads could be individually coloured so that it was easy to identify which magnetic alligator clips 41, 42, 43, 44 match. In another embodiment the insulation of the clips 41, 42, 43, 44 in addition to the leads being coloured or instead of the leads being coloured could be used to identify which alligator clip pairs 41, 41 and 43, 44 match.

It will be understood that the embodiments of the present invention described herein are by way of example only, and that various changes and modifications may be made without departing from the scope of invention.

What I claim is:

1. An alligator clip comprising:

a pair of conductive gripping jaws attached to each other;

biasing means for biasing a first end of the conductive gripping jaws towards each other; and a magnet disposed at the first end of one of the conductive gripping jaws wherein each of the conductive gripping jaws is substantially 'U' shaped, having first and second opposite side walls and a bottom wall and wherein the magnet is an interference fit between the first and second side walls.

2. An alligator clip as claimed in claim 1 wherein the magnet is secured at the first end of one of the conductive gripping jaws.

3. An alligator clip as claimed in claim 2 wherein the magnet is secured using adhesive.

4. An electrical lead having at least one wire, each of the wires having the alligator clip of claim 1 electrically connected at each end.

5. An alligator clip comprising:

a pair of conductive gripping jaws attached to each other;

biasing means for biasing a first end of the conductive gripping jaws towards each other; and a magnet disposed at the first end of one of the conductive gripping jaws, wherein each of the conductive gripping jaws is substantially 'U' shaped, having first and second opposite side walls and a bottom wall and wherein at least one sidewall has at least one protrusion that assists in securing the magnet between the first and second opposite side walls.

6. An alligator clip comprising:

a pair of conductive gripping jaws attached to each other; biasing means for biasing a first end of the conductive gripping jaws towards each other; and a magnet disposed at the first end of one of the conductive gripping jaws, wherein the alligator clip has an extension, the extension being attached at a first end of the extension to the first end of the clip and wherein the second opposite end of the extension extends beyond the first end of the clip, the extension being electrically connected to the conductive gripping jaws.

7. An alligator clip as claimed in claim 6 wherein the extension is in the form of a rod.

8. An alligator clip as claimed in claim 7 wherein the extension is secured to the alligator clip by the magnetic force of the magnet and wherein the magnetic force of the magnet passes through the extension thereby creating a magnetic attraction at the second end of the extension.

9. An alligator clip as claimed in claim 6 wherein the extension is held between the conductive gripping jaws thereby being secured to the alligator clip and wherein the magnetic force of the magnet passes through the extension thereby creating a magnetic attraction at the second end of the extension.

10. An alligator clip as claimed in claim 6 wherein the extension is threaded at a first end and at least a part of the thread is screwed into a threaded socket in the magnet thereby being secured to the alligator clip and wherein the magnetic force of the magnet passes through the extension thereby creating a magnetic attraction at the second end of the extension.

11. An alligator clip as claimed in claim 6 wherein the extension is magnetic.

12. An electrical lead having at least one wire, each of the wires having the alligator clip of claim 6 electrically connected at each end.

13. An electrical lead having at least one wire, each of the wires having the alligator clip of claim 7 electrically connected at each end.

14. An electrical lead having at least one wire, each of the wires having the alligator clip of claim 9 electrically connected at each end.

15. An electrical lead having at least one wire, each of the wires having the alligator clip of claim 10 electrically connected at each end.

16. An electrical lead having at least one wire, each of the wires having the alligator clip of claim 11 electrically connected at each end.

17. An electrical lead having at least one wire, each of the wires having, electrically connected at each end, an alligator clip having a pair of conductive gripping jaws attached to each other; biasing means for biasing a first end of the conductive gripping jaws towards each other; and a magnet disposed at the first end of one of the conductive gripping jaws.

* * * * *